US010987927B2

(12) United States Patent
Kaiba et al.

(10) Patent No.: US 10,987,927 B2
(45) Date of Patent: Apr. 27, 2021

(54) LIQUID DISCHARGE HEAD, HEAD UNIT, APPARATUS FOR DISCHARGING LIQUID, AND LIQUID DISCHARGING METHOD

(71) Applicants: Tadashi Kaiba, Tokyo (JP); Shuusei Murai, Tokyo (JP)

(72) Inventors: Tadashi Kaiba, Tokyo (JP); Shuusei Murai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/526,126

(22) Filed: Jul. 30, 2019

(65) Prior Publication Data

US 2020/0039217 A1 Feb. 6, 2020

(30) Foreign Application Priority Data

Aug. 1, 2018 (JP) ..... JP2018-144896
Jul. 25, 2019 (JP) ..... JP2019-136953

(51) Int. Cl.
*B41J 29/38* (2006.01)
*B41J 2/135* (2006.01)
*B41J 2/175* (2006.01)

(52) U.S. Cl.
CPC ..... *B41J 2/135* (2013.01); *B41J 2/17596* (2013.01); *B41J 2202/01* (2013.01)

(58) Field of Classification Search
CPC ..... B41J 2/14; B41J 2/04; B41J 2/17596
See application file for complete search history.

(56) References Cited

U.S. PATENT DOCUMENTS 4,628,330 A * 12/1986 Suga ..... B41J 2/04 251/129.01
4,875,058 A 10/1989 Vonasek
2005/0103902 A1 5/2005 Hornsell et al.
2012/0105522 A1* 5/2012 Wallsten ..... B41J 2/17596 347/9
2018/0086060 A1 3/2018 Wallsten et al.
2019/0336990 A1 11/2019 Fritz et al.
2019/0337006 A1 11/2019 Fritz et al.

FOREIGN PATENT DOCUMENTS

DE 102016014947 6/2018
DE 102016014955 6/2018
EP 1088987 4/2001
JP S61-79667 4/1986
JP 4123897 7/2008
WO 2016/135545 9/2016

OTHER PUBLICATIONS

Extended European Search Report for 19189271.0 dated Jan. 8, 2020.

* cited by examiner

*Primary Examiner* — Lam S Nguyen
(74) *Attorney, Agent, or Firm* — IPUSA, PLLC

(57) ABSTRACT

A liquid discharge head for controlling discharging of liquid, the liquid discharge head including a valve body configured to be movable, and to be pressed towards a discharge port from which the liquid is discharged; and a recessed portion provided in the valve body at a position facing the discharge port.

8 Claims, 12 Drawing Sheets

LIQUID DISCHARGE HEAD, HEAD UNIT, APPARATUS FOR DISCHARGING LIQUID, AND LIQUID DISCHARGING METHOD

CROSS-REFERENCE TO RELATED APPLICATION

The present application is based on and claims priority under 35 U.S.C. § 119 to Japanese Patent Application No. 2018-144896, filed on Aug. 1, 2018, and Japanese Patent Application No. 2019-136953, filed on Jul. 25, 2019, the contents of which are incorporated herein by reference in their entirety.

BACKGROUND OF THE INVENTION

1. Field of the Invention

The present invention relates to a liquid discharge head, a head unit, an apparatus for discharging liquid, and a liquid discharging method.

2. Description of the Related Art

As a liquid discharge head of a coating apparatus that performs coating or printing on a vehicle body or the like, for example, there is a liquid discharge head using a valve nozzle indicated in Patent Document 1. In this liquid discharge head, an electromagnetic driving mechanism is used as a driving means for opening and closing the valve, but in some cases, a piezo driving mechanism is used in order to increase the driving speed (opening and closing speed) of the valve.

FIG. 10A is a cross-sectional view illustrating a state when the liquid discharge head of the related art is opened, and FIG. 10B is a cross-sectional view illustrating a state when the liquid discharge head of the related art is closed. A liquid discharge head 100 of the related art illustrated in FIGS. 10A and 10B includes a housing 101 having a discharge port 102 at the leading end of the liquid discharge head 100 and an ink injection port 103 at the side wall of the liquid discharge head 100; a valve body 105, which is sealed by an O-ring 104, arranged in the housing 101 so as to face the discharge port 102 and so as to be capable of moving back and forth inside the housing 101; a piezoelectric actuator 106 housed in the housing 101 in a state of being coupled to the valve body 105; and a pair of power supply leads 107*a* and 107*b* connected to the actuator 106. The leading end of the valve body 105, facing the discharge port 102 for discharging ink of the liquid discharge head 100 of the related art, is formed of a cemented carbide containing tungsten or the like to avoid wearing down.

As illustrated in FIG. 10A, when the valve body 105 is separated from the discharge port 102, in a space surrounding the leading end portion of the valve body 105, there is an ink chamber 108 filled with ink injected from the ink injection port 103. In this state, when the actuator 106 is driven, the actuator 106 is extended and the valve body 105 moves in a direction toward the discharge port 102, and by this process, the ink facing the valve body 105 is pressed to the discharge port 102, such that ink dots are discharged from the discharge port 102 as illustrated in FIG. 10B.

Patent Document 1: Japanese Patent No. 4123897

SUMMARY OF THE INVENTION

According to one aspect of the present invention, there is provided a liquid discharge head for controlling discharging of liquid, the liquid discharge head including a valve body configured to be movable, and to be pressed towards a discharge port from which the liquid is discharged; and a recessed portion provided in the valve body at a position facing the discharge port.

DETAILED DESCRIPTION OF THE PREFERRED EMBODIMENTS

Figure 1:
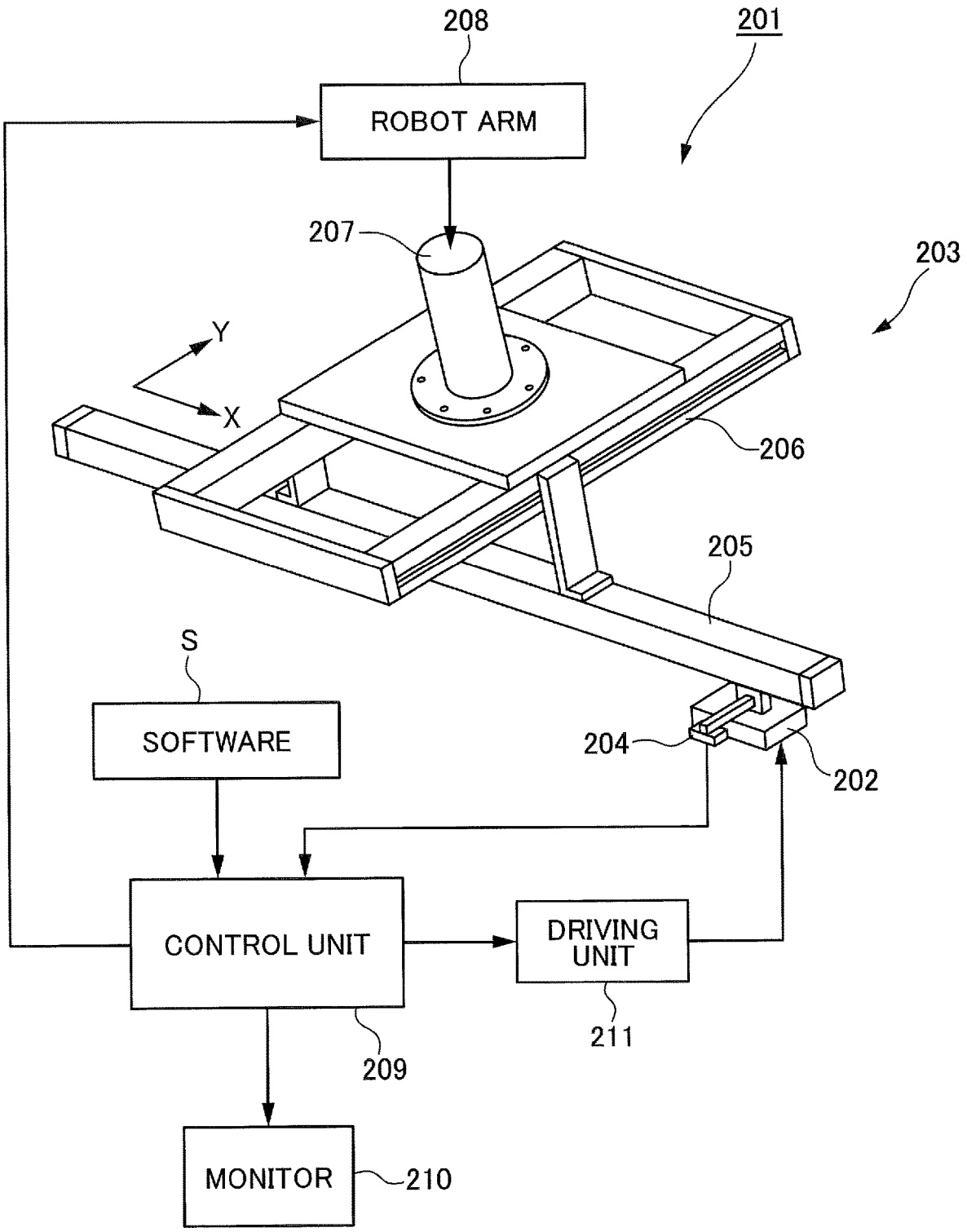
FIG. 1 is a block diagram illustrating a configuration of an ink jet printer as an example of an apparatus for discharging liquid according to an embodiment of the present invention.

The liquid discharge head of the related art described above has a problem in that the discharging speed of the ink dots is low, and, therefore, the distance of linear movement of the ink dots is short. Thus, it is difficult to use the liquid discharge head for purposes where it is desirable to have a certain distance between the liquid discharge head and the object to be coated.

A problem to be addressed by an embodiment of the present invention is to provide a liquid discharge head, a head unit, an apparatus for discharging liquid, and a liquid discharging method, by which the distance of linear movement of ink dots can be increased compared to the related art.

Embodiments of the present invention will be described by referring to the accompanying drawings.

In the present application, an "apparatus for discharging liquid" is an apparatus that includes a liquid discharge head or a head unit including the liquid discharge head, and that drives the liquid discharge head to discharge liquid. Examples of an apparatus for discharging liquid include not only an apparatus capable of discharging liquid to an object to which the liquid can adhere, but also an apparatus for discharging liquid toward gas or liquid.

The "apparatus for discharging liquid" may include a means for feeding and conveying an object to which liquid can adhere and discharging sheets, as well as a pre-processing device, a post-processing device, and the like.

Examples of the "apparatus for discharging liquid" include an image forming apparatus that is an apparatus that discharges ink to form an image on a sheet, and a stereoscopic shaping apparatus (three-dimensional shaping apparatus) that discharges shaping liquid onto a powder layer formed with powder in a layered form in order to shape a stereoscopic shaped object (three-dimensional shaped object).

The "apparatus for discharging liquid" is not limited to an apparatus by which a significant image such as a character or a figure, etc., is visualized by the discharged liquid. For example, a pattern or the like having no meaning may be formed or a three-dimensional image may be formed.

The "object to which liquid can adhere" refers to an object to which liquid can adhere at least temporarily, including an object to which the liquid is adhered and fixed, adhered and permeated, or the like. Specific examples include a recording-target medium such as paper, recording paper, a recording sheet, a film, cloth, and the like; an electronic component such as an electronic substrate, a piezoelectric element, and the like; and a medium such as a powder layer (powder layer), an organ model, an inspection cell, and the like, and all kinds of media to which liquid adheres are included unless otherwise specifically limited.

The material of the "object to which liquid can adhere" may be any material as long as liquid can adhere to the material at least temporarily, such as paper, yarn, fiber, fabric, leather, metal, plastic, glass, wood, ceramics, or the like.

The "liquid" is not particularly limited as long as the liquid has viscosity and surface tension by which the liquid can be discharged from the head, but it is preferable that the viscosity is 30 mPa·s or less under normal temperature and normal pressure or by heating or cooling. More specifically, examples of the liquid are solutions, suspensions, emulsions, and the like including solvents such as water and organic solvents; colorants such as dyes and pigments; function imparting materials such as polymerizable compounds, resins, and surfactants; biocompatible materials such as deoxyribonucleic acid (DNA), amino acids, proteins, and calcium; edible materials such as natural dyes, and the like, and these can be used, for example, in ink for inkjet printing, a surface treatment liquid, liquid for forming components of electronic elements and light emitting elements and electronic circuit resist patterns, three-dimensional shaping material liquid, and the like.

Examples of the "apparatus for discharging liquid" include an apparatus in which a liquid discharge head and an object to which liquid can adhere are relatively moved, but an embodiment of the present invention is not limited as such. Specific examples include a serial device having an element for moving the liquid discharge head (liquid discharge head moving mechanism), a line device in which the liquid discharge head is not moved, and the like.

Other examples of the "apparatus for discharging liquid" include a treatment liquid application apparatus for discharging a treatment liquid to a sheet in order to apply the treatment liquid to the surface of the sheet for the purpose of modifying the surface of the sheet, and a spray granulation apparatus for spraying a composition liquid, in which a raw material is dispersed in a solution, through a nozzle, to granulate fine particles of the raw material.

In the present application, the "head unit" is an apparatus including at least one liquid discharge head, a liquid supply path through which liquid is supplied to the liquid discharge head, and a liquid supply port through which liquid is supplied to the liquid supply path.

Figure 2:
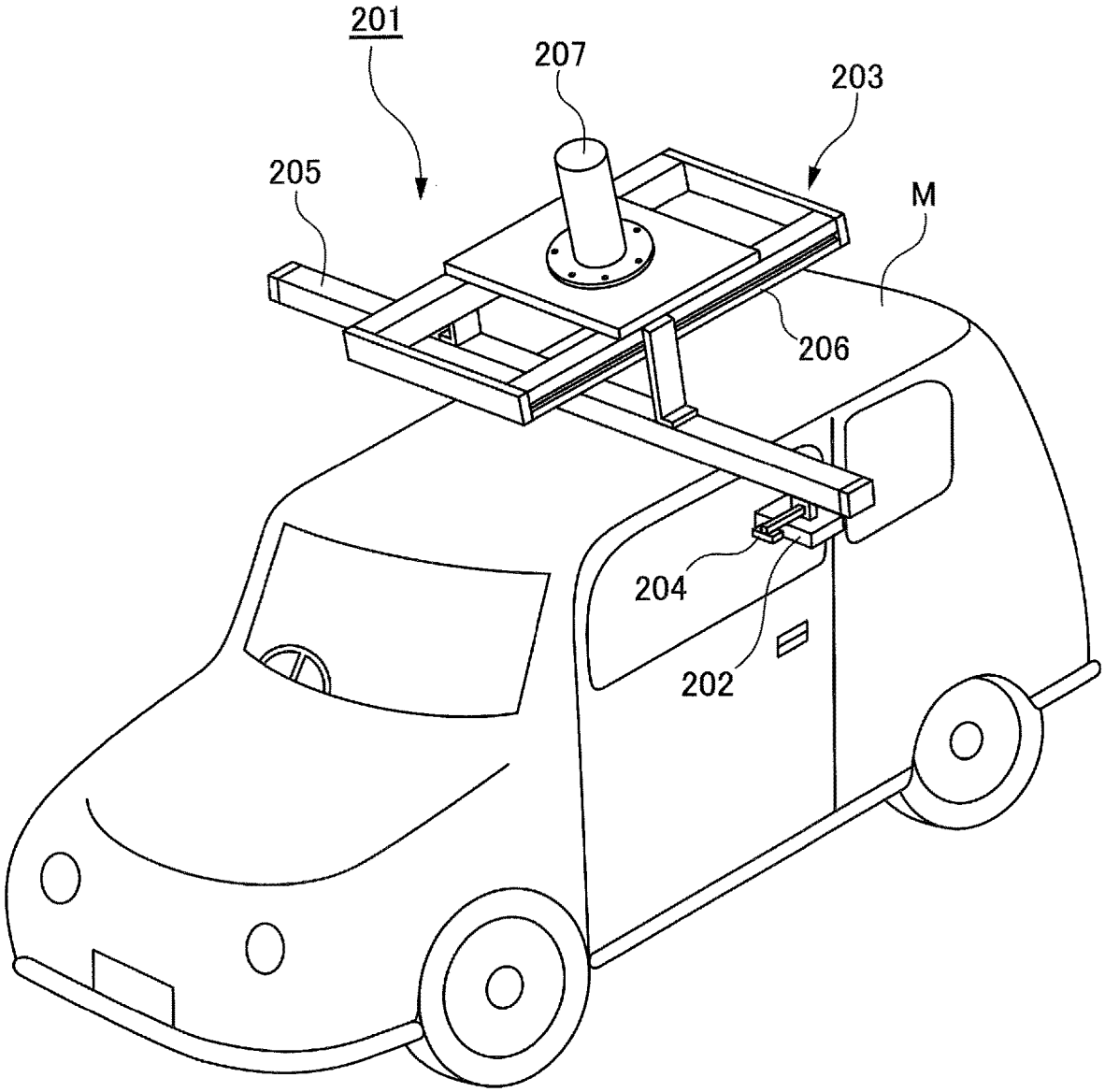
FIG. 2 is an explanatory diagram illustrating an arrangement example of the ink jet printer illustrated in FIG. 1 with respect to a vehicle that is a printing target according to an embodiment of the present invention.
Figure 3:
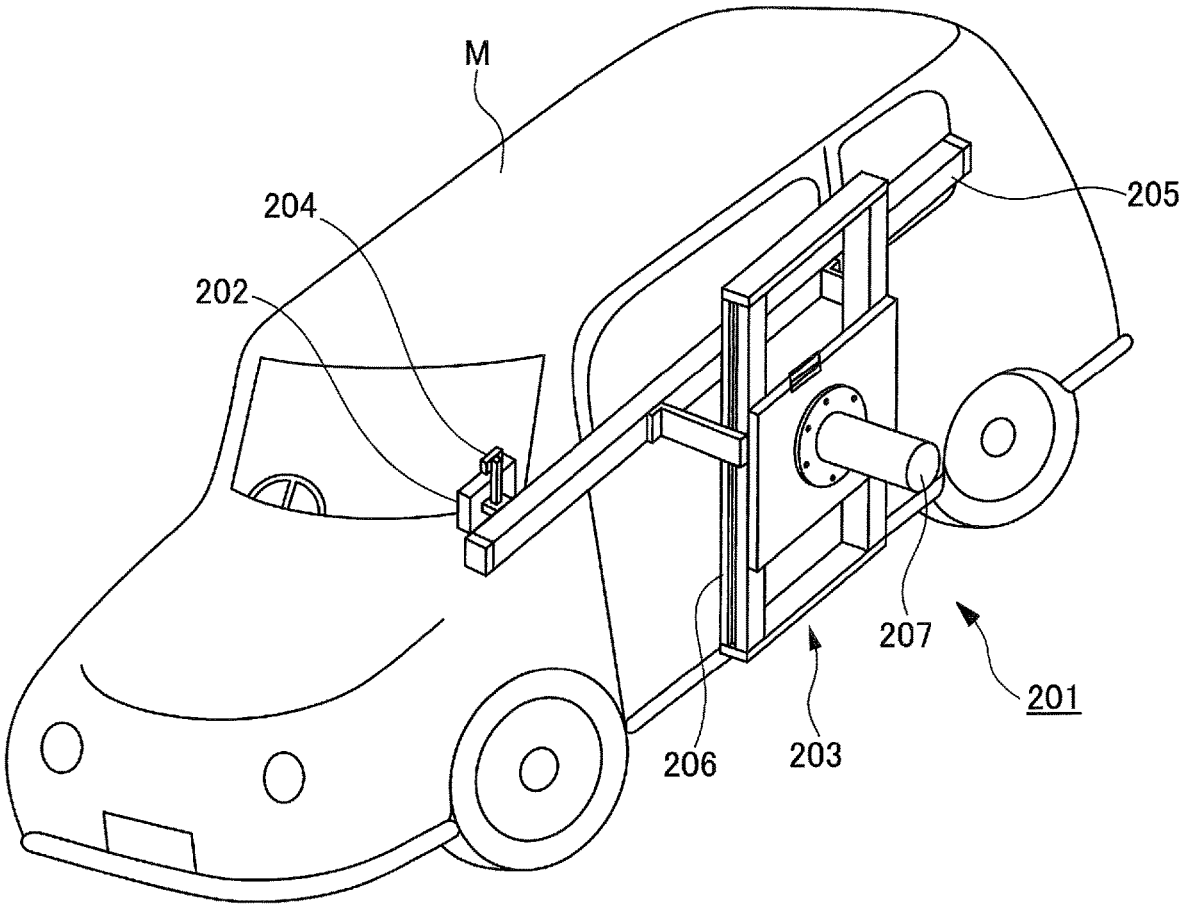
FIG. 3 is an explanatory diagram illustrating another arrangement example of the ink jet printer illustrated in FIG. 1 with respect to a vehicle that is a printing target according to an embodiment of the present invention.
Figure 4A:
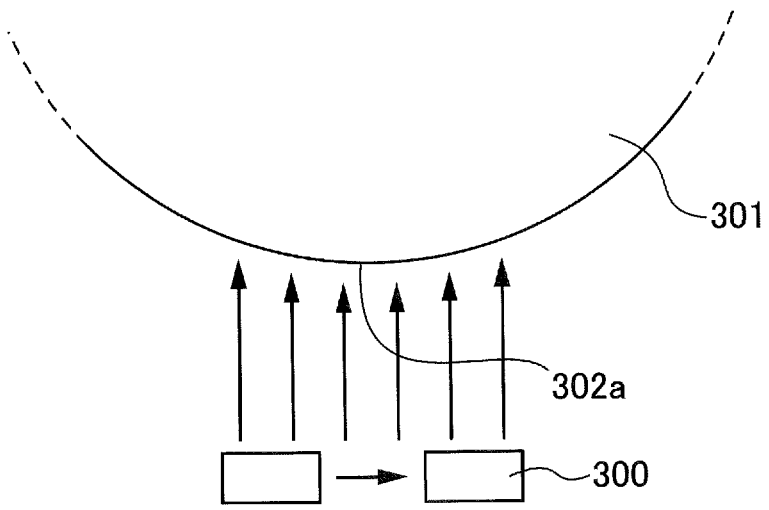
FIGS. 4A to 4C are explanatory diagrams in the case where an image is printed on a spherical surface by an ink jet printer according to an embodiment of the present invention.
Figure 4B:
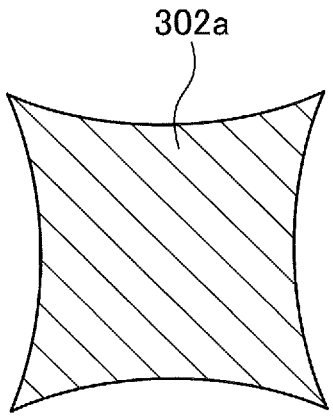
Figure 4C:
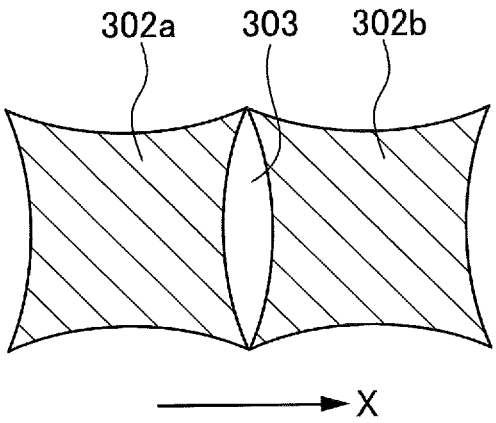

First, with reference to FIGS. 1 to 4C, a configuration of an inkjet printer 201 will be described as an example of an apparatus for discharging liquid, to which the liquid discharge head according to an embodiment is applied. FIG. 1 is a configuration diagram illustrating a configuration of an inkjet printer 201 as an example of an apparatus for discharging liquid according to an embodiment. FIG. 2 is an explanatory diagram illustrating an arrangement example of the inkjet printer 201 illustrated in FIG. 1 with respect to an automobile M that is the printing target (coating target object). FIG. 3 is an explanatory diagram illustrating another arrangement example of the inkjet printer 201 illustrated in FIG. 1 with respect to the automobile M that is the printing target. FIGS. 4A to 4C are explanatory diagrams of a case where an image is printed on a spherical surface by the inkjet printer. FIG. 4A is an explanatory diagram in the case where an image is printed on a spherical surface by the inkjet printer 201, FIG. 4B is an explanatory diagram illustrating a result in the case where a quadrangle is printed on a spherical surface, and FIG. 4C is an explanatory diagram in the case where quadrangles are continuously printed on a spherical surface by the inkjet printer 201.

As illustrated in FIG. 1, the inkjet printer 201 mainly includes a print head 202 according to an inkjet method, a camera 204 as an image capturing means disposed in the vicinity of the print head 202, an X-Y table 203 for moving the print head 202 and the camera 204 in the X direction and the Y direction, a control unit 209 for moving the X-Y table 203 based on image editing software S for editing an image captured by the camera 204 and a preset control program to discharge ink from the print head 202 and control the printing on a printing target surface, and a driving unit 211 for positioning the camera 204 and the print head 202 at predetermined positions based on control by the control unit 209 to perform image capturing and printing operations.

The print head 202 includes a plurality of valve nozzles as liquid discharge heads, that discharges ink (liquid) toward the coating target surface of a coating target object M. Note that "ink" referred to herein also includes "a coating material". Ink is discharged from each of the valve nozzles perpendicularly with respect to the print head 202. That is, the ink discharge surface of the print head 202 is parallel to an X-Y plane formed by the movement of the X-Y table 203, and the ink dots discharged from the valve nozzles are discharged in a direction perpendicular to the X-Y plane. The ink discharging directions of the ink discharged from the respective valve nozzles are in parallel to each other. Each valve nozzle is coupled to an ink tank of a predetermined color, and the ink tank is pressurized by a pressurizing device (not illustrated), so that ink dots can be discharged onto the print surface without any problem if the distance between each valve nozzle and the print surface of the coating target object M is approximately 20 cm.

The X-Y table 203 mainly includes an X shaft 205 formed with a linear movement mechanism, and a Y shaft 206 for moving the X shaft in the Y direction while holding the X shaft 205 by two arms, and the print head 202 and the camera 204 to be described later are attached to a slider (not illustrated) of the X shaft 205. A shaft 207 is provided on the Y shaft 206, and by holding the shaft 207 by a robot arm 208, the print head 202 can be freely arranged at a predetermined position where printing is to be performed on the coating target object M. For example, when the coating target object M is an automobile, the print head 202 can be arranged on an upper position as illustrated in FIG. 2, or the print head 202 can be arranged at a side position as illustrated in FIG. 3. The operation of the robot arm 208 is controlled based on a program stored in advance in the control unit 209.

The camera 204 is disposed on a slider (not illustrated) of the X shaft 205 that is in the vicinity of the print head 202, and captures images of a predetermined range of the printing target surface of the coating target object M at fixed fine intervals while moving in the X-Y direction. The camera 204 is a so-called digital camera, and as described above, specifications of lenses and specifications of the resolution capable of capturing a plurality of sub-divided images in a predetermined range of the printing target surface, are appropriately selected. The camera 204 captures a plurality of sub-divided images on the printing target surface continuously and automatically in accordance with a program provided in advance in the control unit 209.

The control unit 209 includes a storage device for recording and saving various programs, data of a captured image, data of an image to be printed, and the like; a central processing unit for executing various processes according to programs; an input device such as a keyboard and a mouse; and a so-called microcomputer including a digital versatile disk (DVD) player and the like according to need; and further includes a monitor 210 to display information input to the control unit 209, processing results by the control unit 209, and the like. The control unit 209 performs image processing, by using image processing software, on a plurality of pieces of sub-divided image data captured by the camera 204; generates a composite print surface obtained by projecting the printing target surface, of the coating target object M that is not planar, onto a plane; superimposes, on the composite print surface, a drawing target image A, which is an image to be printed so as to be continuous with the image already printed on the printing target surface; and edits the drawing target image A so as to be continuous with the edge portion of the printed image, thereby generating a drawing target edit image B. For example, with respect to a print image 302*b* (corresponding to the drawing target image A) illustrated in FIG. 4C, the print image 302*b* is edited (deformed) so as to be aligned with the composite print surface so that a non-print region 303 is not formed between an adjacent print image 302*a* and the print image 302*b*, thereby generating the drawing target edit image B. Then, the print image 302*b* can be printed without any gap between the print image 302*b* and the print image 302*a* that has already been printed, by actually printing the print image 302*b* by the print head 202 based on the drawing target edit image B. The capturing of the plurality of sub-divided images by the camera 204 and the printing by discharging ink from each of the nozzles of the print head 202 are performed by the driving unit 211 controlled by the control unit 209.

In FIG. 4A, in the case where a two-dimensional quadrangle is printed on the surface (spherical surface) of a coating target object 301 that is a spherical object by inkjet nozzles, the discharging directions of ink discharged from the respective inkjet nozzles mounted in a nozzle head 300 is illustrated. In FIG. 4B, the ink discharged from inkjet nozzles mounted on the nozzle head 300 is discharged in a direction perpendicular to the nozzle head 300, and, therefore, the print image 302*a* printed on the surface of the coating target object 301 is illustrated to have a quadrangle shape with distorted peripheries.

[Configuration of Liquid Discharge Head]

Figure 5A:
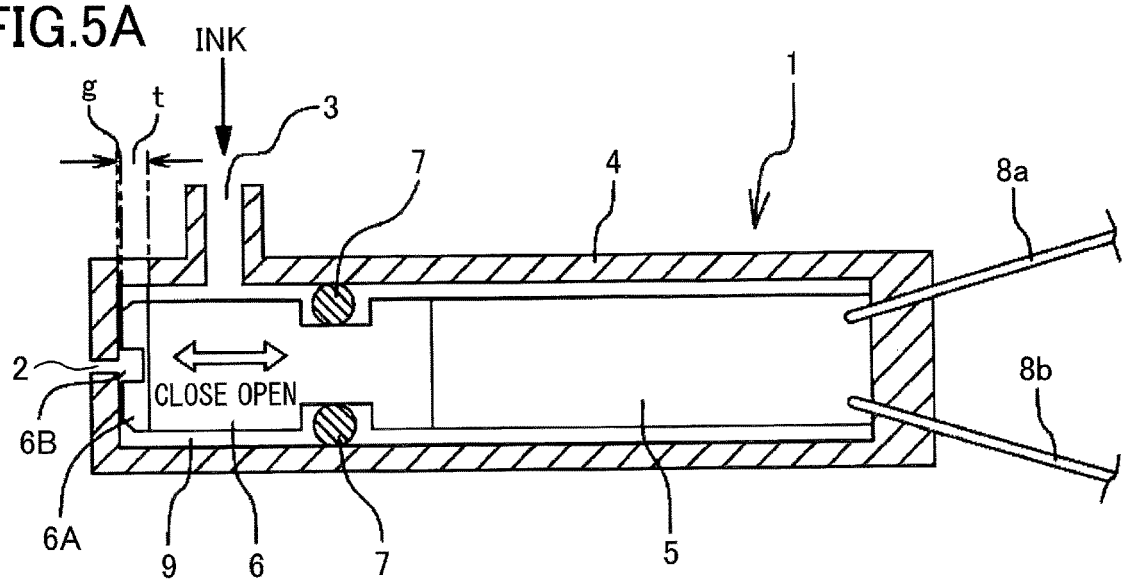
FIGS. 5A to 5C are cross-sectional views of the main part of a liquid discharge head according to an embodiment of the present invention.
Figure 5B:
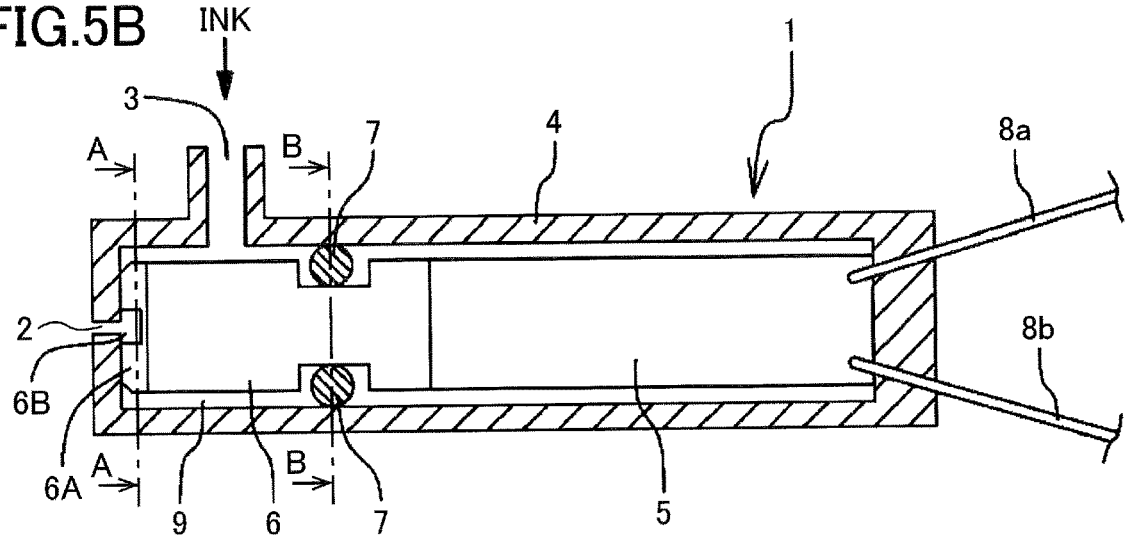
Figure 5C:
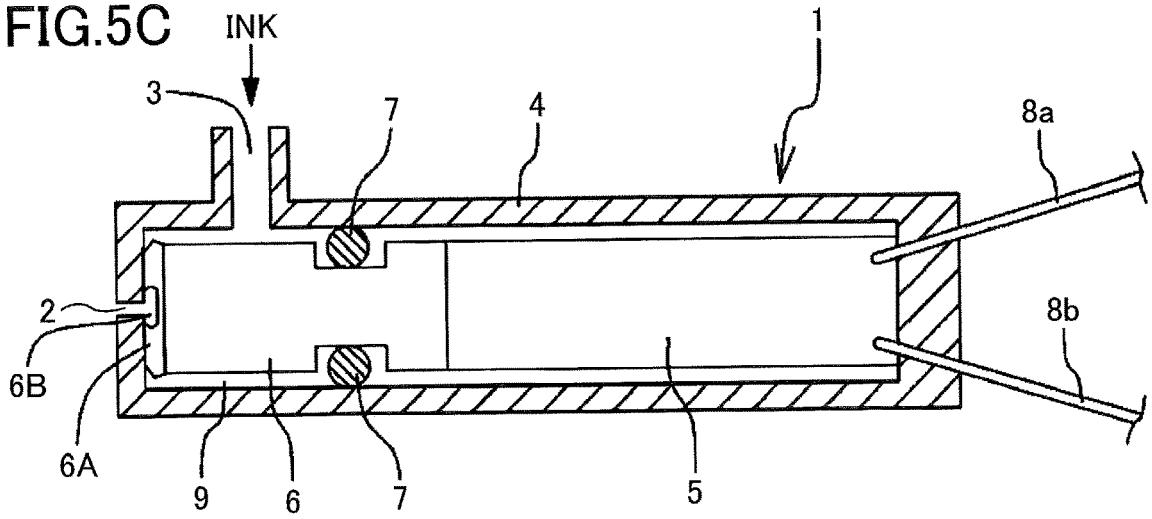
Figure 6:
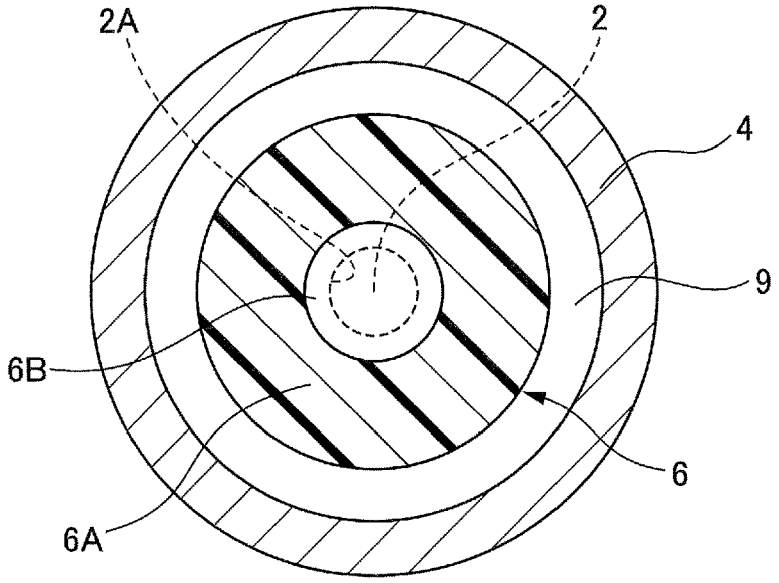
FIG. 6 is a cross-sectional view taken along a line A-A in FIG. 5B including a leading end portion of a valve body according to an embodiment of the present invention.
Figure 7:
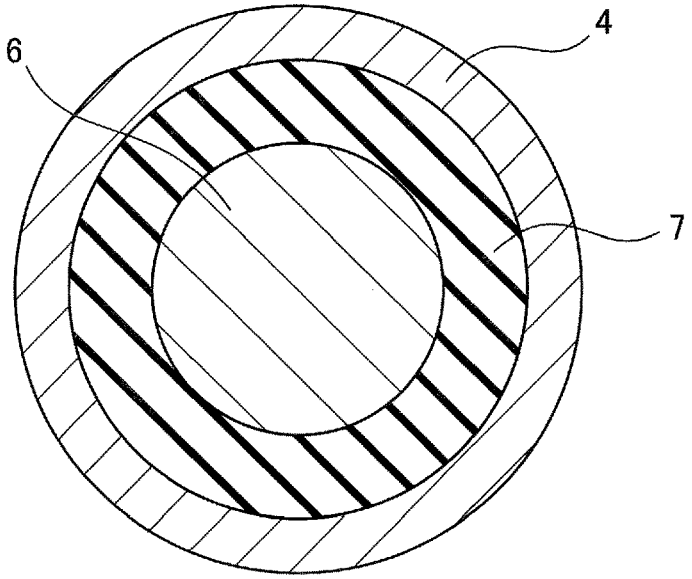
FIG. 7 is a cross-sectional view taken along line B-B in FIG. 5B and including a sealing member according to an embodiment of the present invention.

Hereinafter, a liquid discharge head 1 according to an embodiment will be described in detail. FIGS. 5A to 5C are cross-sectional views of the main part of the embodiment of the liquid discharge head 1 according to the embodiment. FIG. 5A is a cross-sectional view illustrating a state immediately before a valve body 6 contacts a discharge port 2, FIG. 5B is a cross-sectional view illustrating a state in which the valve body 6 contacts the discharge port 2, and FIG. 5C is a cross-sectional view illustrating a state in which a leading end portion 6A of the valve body 6 is compressed. FIG. 6 is a cross-sectional view taken along line A-A in FIG. 5B, and is a cross-sectional view including the leading end portion 6A of the valve body 6. FIG. 7 is a cross-sectional view taken along line B-B in FIG. 5B, and is a cross-sectional view including a sealing member 7.

As illustrated in FIGS. 5A to 5C, the liquid discharge head 1 mainly includes a hollow nozzle body 4 that is provided with the discharge port 2 for discharging ink at the leading end and that is provided with an injection port 3 for injecting ink in the vicinity of the discharge port 2; an actuator (piezoelectric element) 5 that is provided in the nozzle body 4 and that expands and contracts (expands and contracts in the left-right direction as viewed in FIGS. 5A to 5C) according to a voltage applied from outside; the valve body 6 for opening and closing the discharge port 2; the sealing member 7 fitted outside the valve body 6 to prevent ink from flowing to the actuator 5 side; and a pair of lead wires 8*a* and 8*b* for power supply connected to the actuator 5.

The nozzle body 4 is formed in a cylindrical shape or a slightly rectangular cylindrical shape as a whole, and is closed except for the discharge port 2 and the injection port 3. The discharge port 2 is a small opening drilled at the leading end of the nozzle body 4, such that ink dots are discharged from the discharge port 2. More specifically, one end of the nozzle body 4 in the extending direction is sealed by an end wall 4A (see FIG. 8), and the discharge port 2 is provided to penetrate through the end wall 4A. In the following description, the inner surface of the end wall 4A is referred to as a discharge surface 2B (see FIG. 8). The injection port 3 is provided on a side surface of the nozzle body 4 in the vicinity of the discharge port 2, and is connected to a liquid tank 23 (see FIG. 12), and ink (or coating material) is continuously supplied to an ink chamber 9 by a pressurizing unit 28 (see FIG. 12). Note that a liquid supply system 21 including the pressurizing unit 28 will be described later with reference to FIG. 12.

The actuator 5 is a piezoelectric element and is formed by using zirconia ceramic or the like. The shape, etc., of the actuator 5 is appropriately set according to the amount of ink dots to be discharged, and the like. The actuator 5 operates by continuously receiving a voltage of a predetermined waveform controlled by the control unit 209 (see FIG. 1). Further, the sealing member 7 may be a packing, an O-ring, or the like, and by fitting the sealing member 7 to the valve body 6, ink is prevented from flowing from the injection port 3 side to the actuator 5 side. As illustrated in FIG. 7, the sealing member 7 is provided to seal a gap between the inner peripheral surface of the nozzle body 4 and the outer peripheral surface of the valve body 6.

As illustrated in FIG. 6, the valve body 6 has a shape (columnar in the present embodiment) conforming to the inner shape of the nozzle body 4, and a part of the valve body 6 on the discharge port 2 side, that is, the leading end portion 6A, is made of an elastic resin (for example, fluorocarbon resin, specifically "Teflon": registered trademark of DuPont Corporation), and further, as illustrated in FIGS. 5A to 6, a recessed portion 6B serving as an ink reservoir is formed in a portion of the leading end portion 6A facing the discharge port 2. The recessed portion 6B is of a size for covering the discharge port 2, that is, the recessed portion 6B has an opening diameter that is larger than the diameter of the discharge port 2. The operation of the valve body 6 will be described later.

Figure 8:
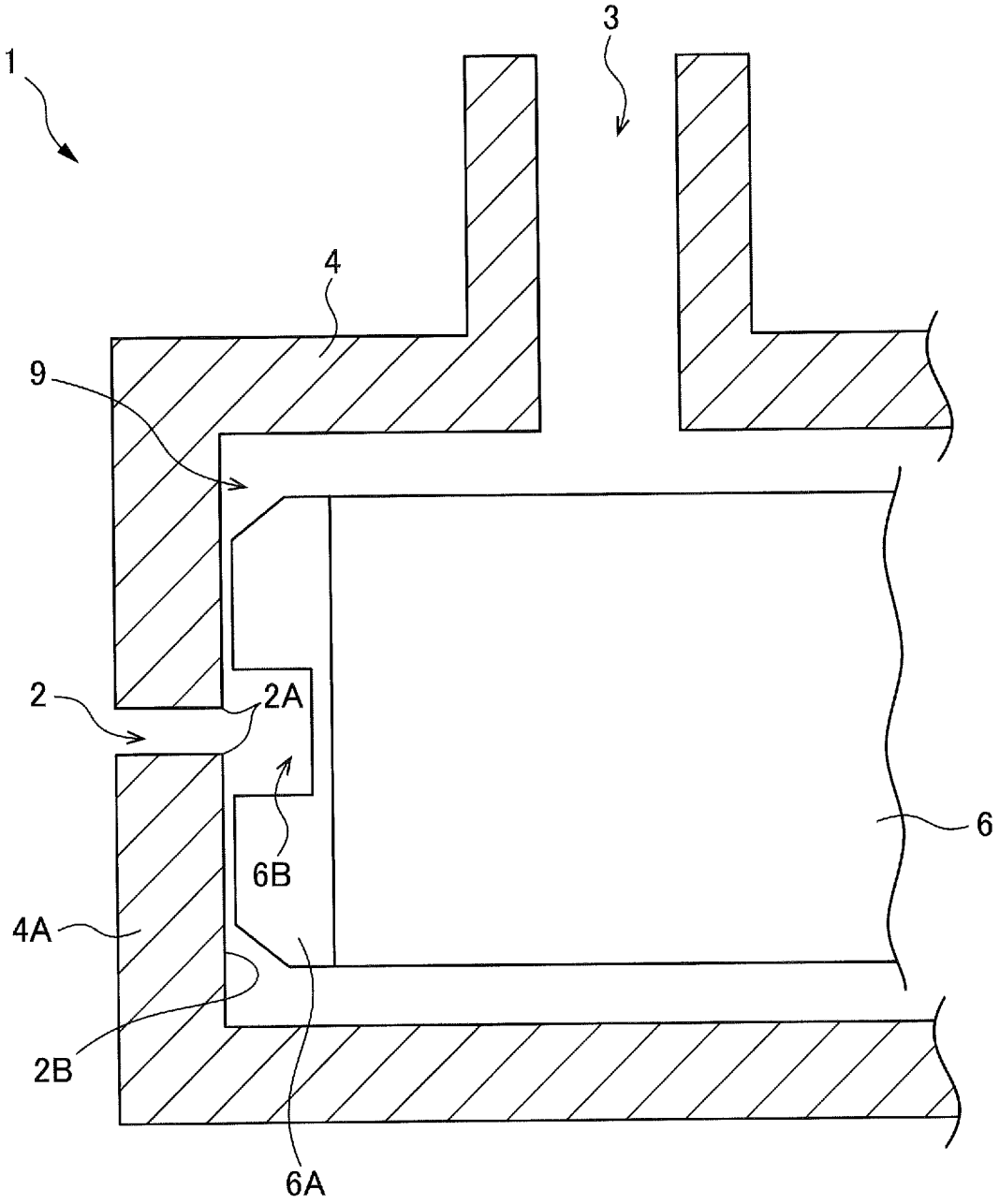
FIG. 8 is an enlarged sectional view of the vicinity of a discharge port in FIGS. 5A to 5C according to an embodiment of the present invention.

FIG. 8 is an enlarged cross-sectional view of the vicinity of the discharge port 2 in FIGS. 5A to 5C. As illustrated in FIGS. 6 and 8, by making the opening diameter of the recessed portion 6B larger than the nozzle diameter (the diameter of the discharge port 2), the discharging performance (the speed, the amount, the linear movement properties, etc.) can be further improved, and the wearing down of a nozzle inner edge 2A can be eliminated. If the nozzle inner edge 2A wears down, the discharge port 2 cannot be successfully closed by a needle (the valve body 6) and ink leakage may occur. Further, if the scraping of both sides of the nozzle inner edge 2A (a pair of portions facing each other in the vertical direction in FIG. 8) becomes asymmetric, there is a possibility that the flow of ink entering the discharge port 2 becomes non-uniform, leading to bending in the discharging. In the present embodiment, the wearing down of the nozzle inner edge 2A can be prevented, and, therefore, the occurrence of these problems can be avoided.

A coating apparatus including the liquid discharge head 1 is configured by arranging, in parallel, a plurality of the liquid discharge heads 1 for discharging ink of different colors.

[Operation of Liquid Discharge Head 1]

Next, the operation of the above-described liquid discharge head 1 will be described. In a state in which no voltage is applied to the actuator 5, the actuator 5 is in a regular state in which the actuator 5 is not deformed, and as illustrated in FIG. 5A, a gap g is formed between the leading end portion 6A of the valve body 6 and the discharge port 2. In this state, no pressurizing force is applied to the discharge port 2, and because the diameter of the discharge port 2 is sufficiently small with respect to the length of the discharge port 2, ink is not discharged from the discharge port 2.

Next, when a predetermined voltage is applied to the actuator 5, the actuator 5 deforms (extends) in the length direction (left-right direction in FIGS. 5A to 5C). One end of the actuator 5 is fixed to the nozzle body 4, and, therefore, the valve body 6 side of the actuator 5 extends so that the valve body 6 is pressed, and accordingly, ink dots are discharged as the end face of the leading end portion 6A of the valve body 6 comes into contact with the discharge surface 2B as illustrated in FIG. 5B. At this time, ink is accommodated in the recessed portion 6B of the leading end portion 6A.

The leading end portion 6A is made of an elastic resin, and, therefore, as illustrated in FIG. 5C, as the valve body 6 is further pressed, the leading end portion 6A is deformed so as to be crushed. Therefore, the volume of the recessed portion 6B decreases such that the valve body 6 presses the ink, and the ink in the recessed portion 6B is pressed outside, and ink dots are discharged from the discharge port 2. At this time, the deformation of the elastic resin, that is, the leading end portion 6A, is instantaneously performed (for example, 50 μs), and, therefore, the ink in the recessed portion 6B is discharged at a high speed (specifically, approximately 10 m/sec), so that the flying distance of the ink dots, in particular, the distance by which the ink dots travel linearly, can be increased. Incidentally, the discharging speed of a valve ink jet nozzle of the related art is 5 m/sec to 6 m/sec. Further, the ink in the recessed portion 6B is discharged, and, therefore, the discharging amount of the ink is increased as compared with the valve ink jet nozzle of the related art.

[Configuration of Head Unit]

Figure 11:
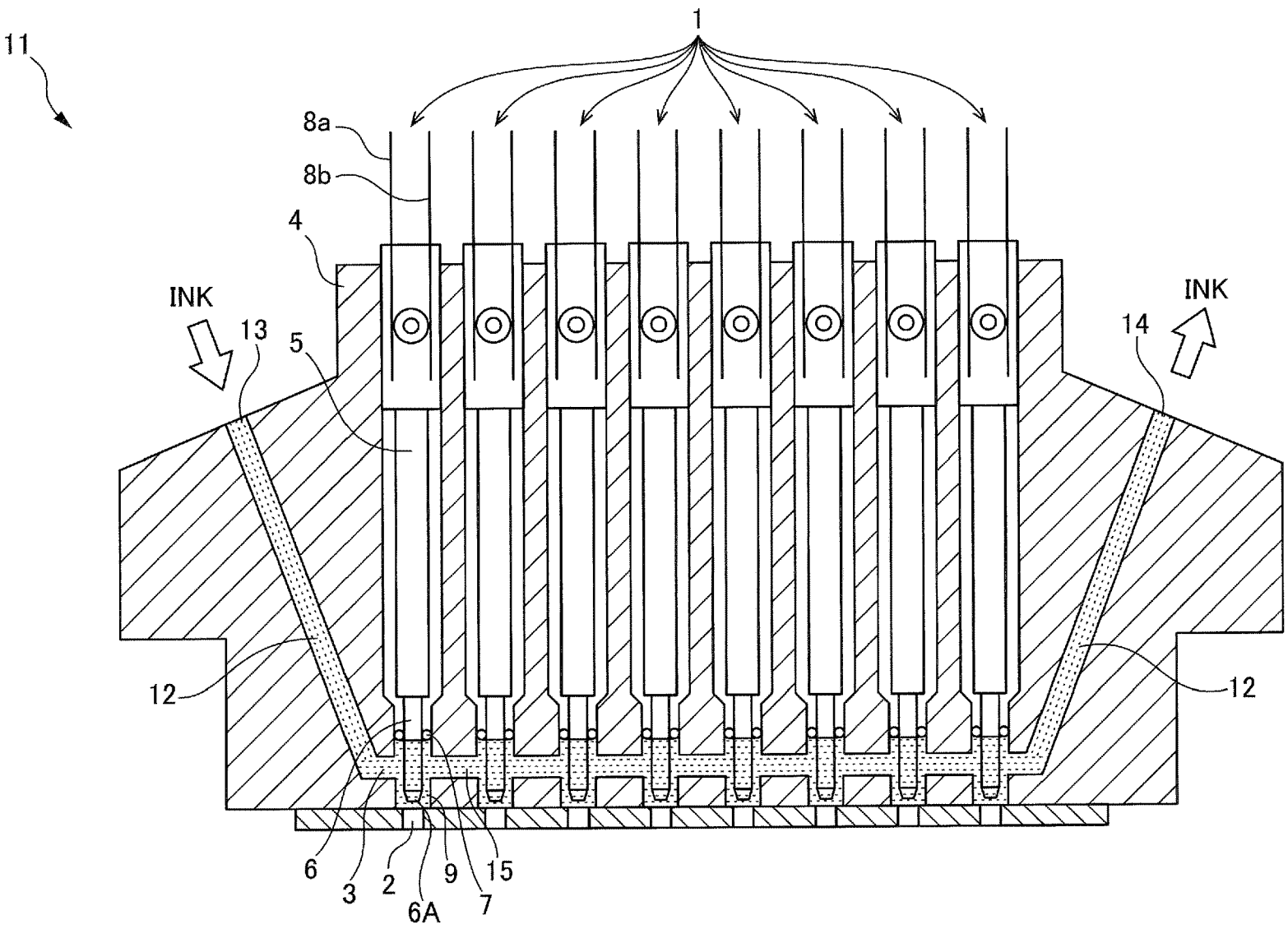
FIG. 11 is a cross-sectional view of a head unit according to an embodiment of the present invention.

The configuration of a head unit 11, to which the above-described liquid discharge head 1 is applied, will be described with reference to FIG. 11. FIG. 11 is a cross-sectional view of the head unit 11 according to an embodiment.

As illustrated in FIG. 11, the head unit 11 includes a plurality of (eight in the example of FIG. 11) the liquid discharge heads 1, a liquid supply path 12 through which ink (liquid) is supplied to the liquid discharge head 1, a liquid supply port 13 through which ink is supplied to the liquid supply path 12, and a liquid discharge port 14 for discharging the ink from the liquid supply path 12.

The basic configuration of the plurality of liquid discharge heads 1 is the same as that described with reference to FIGS. 5A to 8, and the same reference numerals are also used for the corresponding elements in FIG. 11.

In the head unit 11 illustrated in FIG. 11, eight liquid discharge heads 1 are provided such that the respective discharge ports 2 are arranged at substantially equal intervals in one direction (horizontal direction in FIG. 11). Each of the liquid discharge heads 1 is provided to extend in the vertical direction so as to discharge ink downward from the discharge port 2 in the lower part in the drawing. Each liquid discharge head 1 of FIG. 11 is rotated by substantially 90 degrees counterclockwise from the state of FIGS. 5A to 5C, centering on the discharge port 2 side.

The liquid supply path 12 is supplied so as to penetrate through the ink chambers 9 of the respective liquid discharge heads 1, so that the ink flows from one side (left side in FIG. 11) to the other side (right side in FIG. 11) of the arrangement direction of the eight liquid discharge heads 1. That is, the configuration of FIG. 11 differs from the configuration of FIG. 5 in that, in each of the liquid discharge heads 1, a discharge port 15 is provided on the side opposite to the injection port 3.

In the head unit 11 of FIG. 11, the liquid discharge port 14 is usually closed by a valve or the like. When cleaning the head unit 11 or the like, the valve of the liquid discharge port 14 is configured to be opened, thereby facilitating the cleaning of the inside of the head unit 11. Also, usually, ink is supplied from the liquid supply port 13, and the liquid supply path 12 is filled with ink as illustrated in FIG. 11.

[Configuration of Liquid Supply System]

Figure 12:
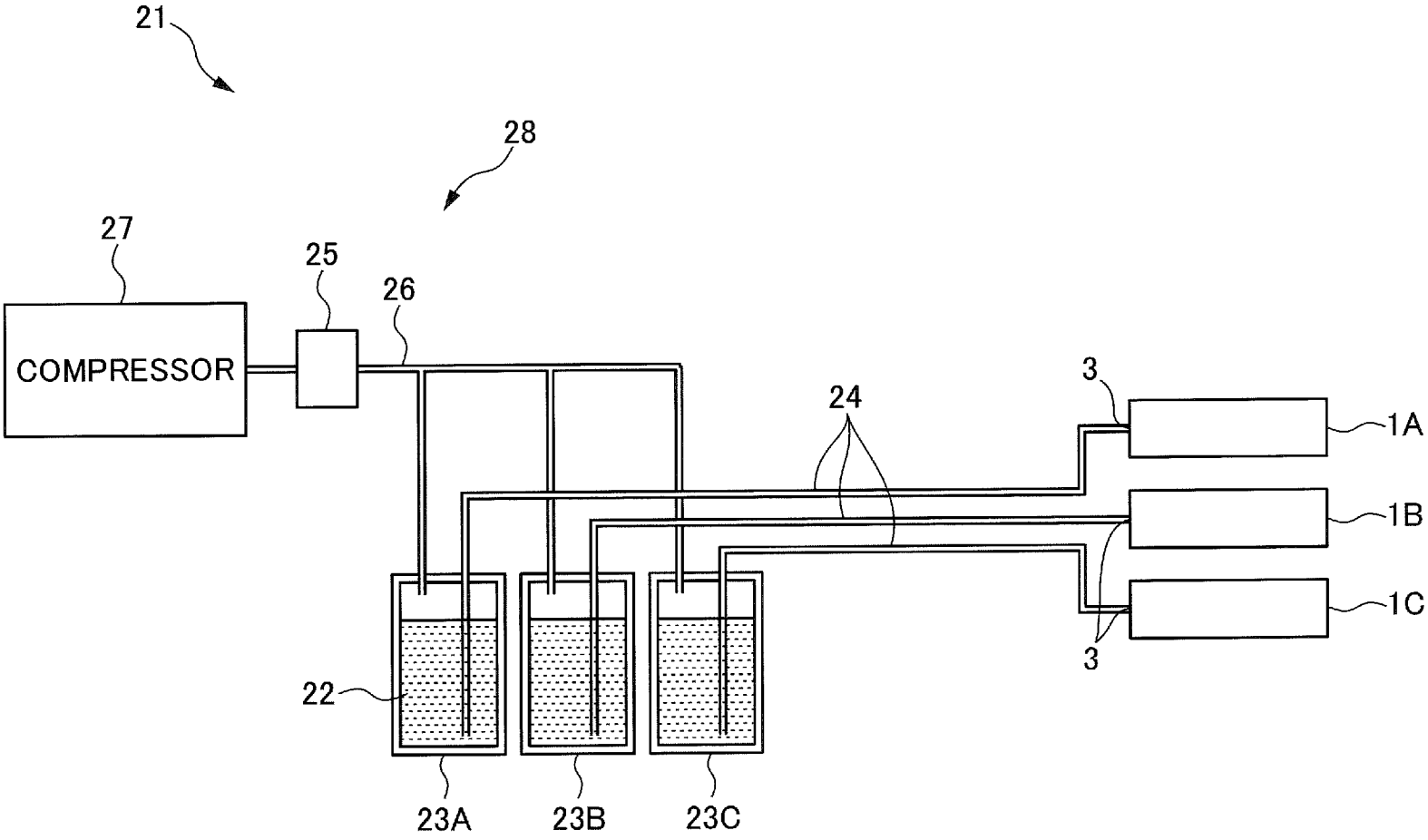
FIG. 12 is an explanatory diagram of a liquid supply system according to an embodiment of the present invention.

Next, the liquid supply system 21 for the liquid discharge heads 1 will be described with reference to FIG. 12. FIG. 12 is an explanatory diagram illustrating the liquid supply system 21.

Here, each of the liquid tanks 23 (23A to 23C) is provided as a sealed container in which liquid 22 of each color, to be discharged from a corresponding one of the liquid discharge heads 1 (1A to 1C), is accommodated. The liquid tank 23 and the injection port 3 of the liquid discharge head 1 are connected to each other via a tube 24.

On the other hand, the liquid tank 23 is connected to a compressor 27 via a pipe 26 including an air regulator 25, and pressurized air from the compressor 27 is supplied to the liquid tank 23.

Accordingly, the pressurized liquid 22 of each color is supplied to the injection port 3 of the corresponding liquid discharge head 1, and the liquid 22 is discharged from the discharge port 2 according to the opening and closing of the valve body 6 as described above. The air regulator 25, the pipe 26, and the compressor 27 function as the pressurizing unit 28 for continuously supplying the liquid (ink) to the ink chamber 9 of each of the liquid discharge heads 1.

[Liquid Discharging Operation]

Figure 13:
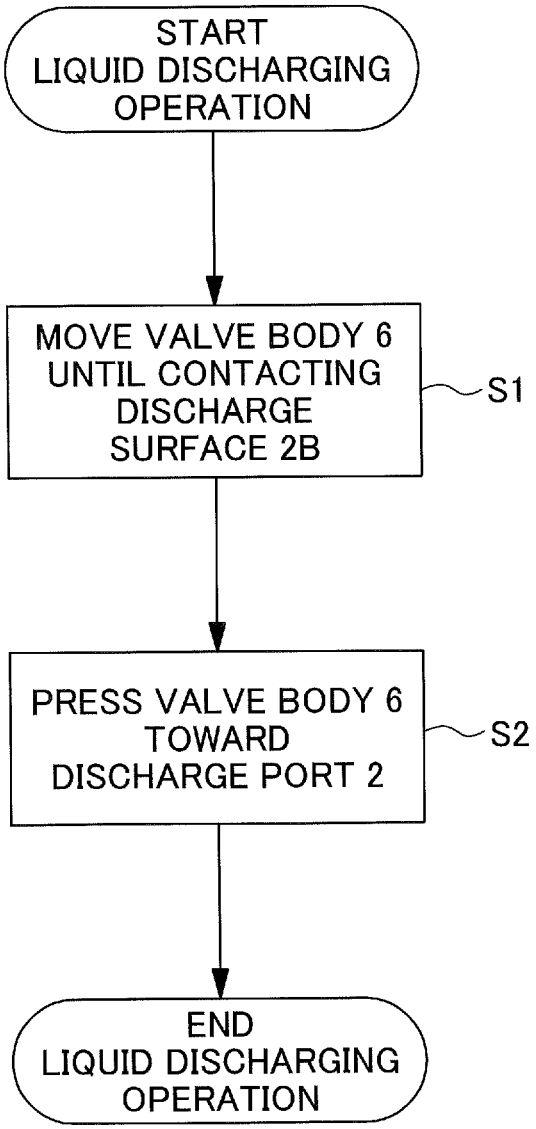
FIG. 13 is a flow chart of a liquid discharging operation according to an embodiment of the present invention.

A method of discharging liquid (ink) will be described with reference to FIG. 13. FIG. 13 is a flowchart of the liquid discharging operation.

When the ink discharging operation is started, basically, the operation starts in a state where ink is filled in the ink chamber 9, in both cases of the single liquid discharge head 1 illustrated in FIGS. 5A to 5C, and the head unit 11 illustrated in FIG. 11. Further, in the case of the head unit 11 of FIG. 11, the liquid discharge port 14 is maintained in a closed state by an electromagnetic valve or the like.

From the above state, in step S1, a waveform (actually an ON/OFF rectangular wave) is applied to the actuator 5 as described above, and as the actuator 5 presses the valve body 6, the valve body 6 is driven, and the leading end portion 6A of the valve body 6 is moved until the leading end portion 6A contacts the discharge surface 2B. Accordingly, the valve body 6 presses the ink so that the ink is pressed toward the discharge port 2 and is discharged from the discharge port 2. At this time, ink is stored in the recessed portion 6B of the valve body 6 formed at the position facing the discharge port 2.

In step S2, the actuator 5 is further driven, and the valve body 6 is further pressed toward the discharge port 2 from the position where the valve body 6 contacts the discharge surface 2B. At this time, the valve body 6 is pressed by a force that causes the leading end portion 6A of the valve body 6 to be deformed so that the volume of the recessed portion 6B is reduced. Accordingly, the valve body 6 presses the ink inside the recessed portion 6B, and the ink in the recessed portion 6B is discharged from the discharge port 2.

Thereafter, the state in which the valve body 6 is in contact with the discharge surface 2B is maintained, whereby leakage of ink from the ink chamber 9 to the discharge port 2 is prevented, and the liquid discharging operation is completed.

EXAMPLE

Figure 9A:
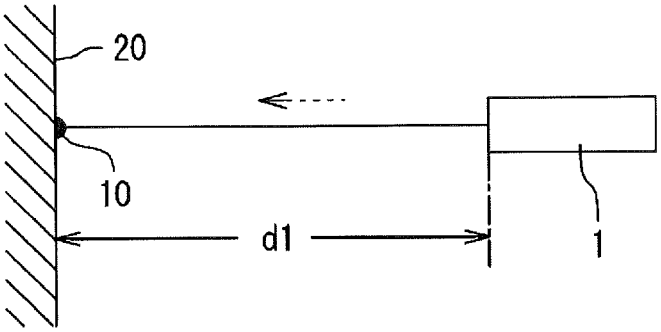
FIGS. 9A and 9B are explanatory diagrams illustrating the reach distance of ink dots of the liquid discharge head according to an embodiment of the present invention and a liquid discharge head of the related art.
Figure 9B:
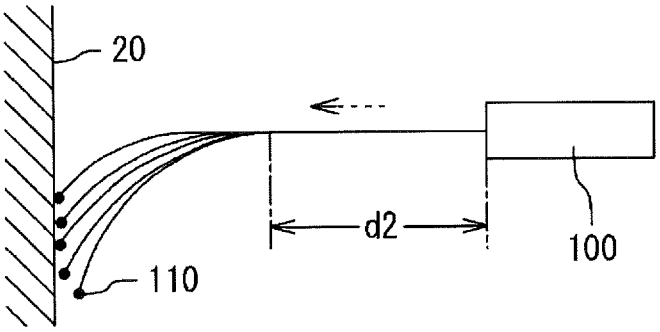
FIG.9B RELATED ART
Figure 10A:
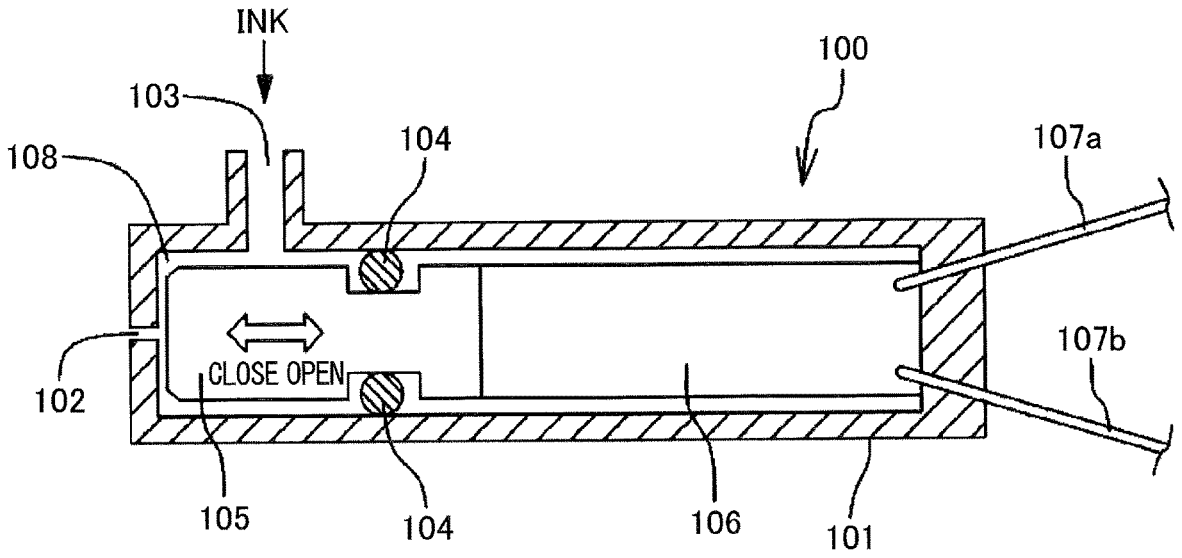
FIG.10A RELATED ART
FIGS. 10A and 10B are cross-sectional views of a liquid discharge head of the related art.
Figure 10B:
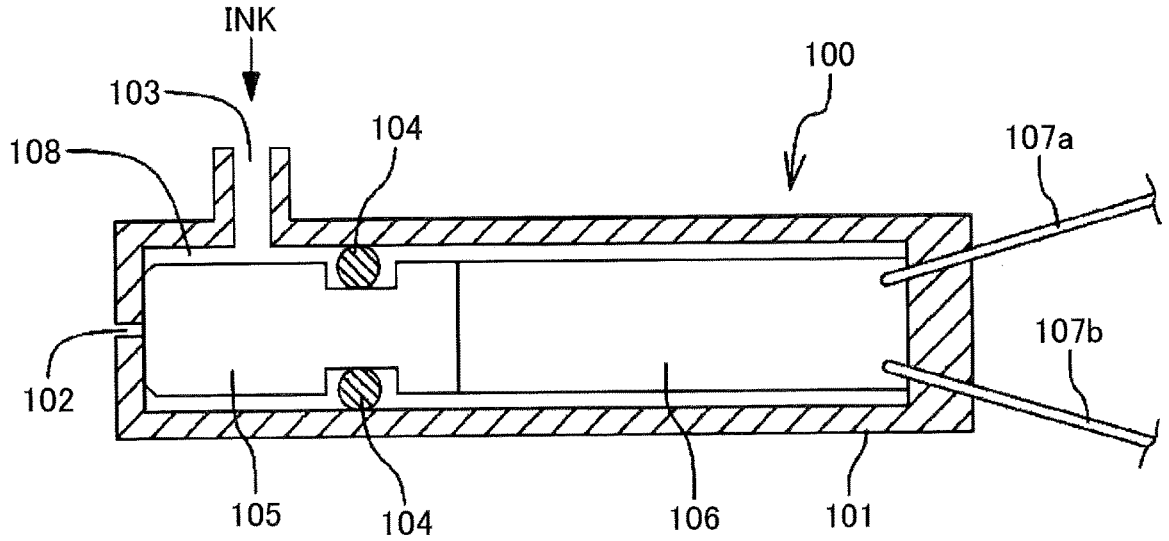
FIG.10B RELATED ART

The inventors of the present invention measured the flying distance of ink dots traveling linearly, with respect to the embodiment illustrated in FIGS. 5A to 5C and the configuration of the related art illustrated in FIGS. 10A and 10B, and the results illustrated in FIGS. 9A and 9B were obtained. Various conditions of the measurement were as follows.

Gap g between the leading end surface of the leading end portion 6A and the inner surface of the nozzle body 4: 20 μm Thickness t of the leading end portion 6A and inner diameter of the recessed portion 6B: 500 μm Hole diameter of the discharge port 2: 100 μm Ink viscosity: 30 mPa·S Pressure applied to the ink chamber 9: 0.45 MPa Linear distance of ink dots from the liquid discharge head 1 according to the present embodiment: d1

Linear distance of ink dots from the liquid discharge head 100 of the related art: d2

FIGS. 9A and 9B are explanatory diagrams illustrating the reaching state of ink with respect to the liquid discharge head 1 according to the embodiment and the liquid discharge head 100 of the related art, respectively. As illustrated in FIG. 9A, the distance by which ink dots 10 discharged from the liquid discharge head 1 according to the embodiment linearly traveled was 100 mm or more. On the other hand, as illustrated in FIG. 9B, the distance by which ink dots 110 of the liquid discharge head 100 of the related art linearly traveled was 50 mm to 60 mm at most. As described above, it has been confirmed that the liquid discharge head 1 according to the present embodiment can achieve a linear travel distance of ink that is 1.67 times to 2 times as long as that of the liquid discharge head 100 of the related art.

According to the liquid discharge head 1 according to the present embodiment, the recessed portion 6B is formed in the valve body 6 at a position facing the discharge port 2, and, therefore, when the valve body 6 is pressed against the discharge port 2, the recessed portion 6B is deformed so as to be crushed and to decrease in volume, and accordingly, the ink dot is pressed out at a high speed, thereby achieving an effect that the distance at which the ink dot 10 travels linearly can be increased. Accordingly, the distance between the leading end of the liquid discharge head 1 and a coating target object 20 can be increased.

Further, the leading end portion 6A of the valve body 6 arranged facing the discharge port 2 is formed of an elastic resin, and the recessed portion 6B having an opening diameter larger than the opening diameter of the discharge port 2 is provided on the leading end surface of the leading end portion 6A. Therefore, it is possible to increase the amount of ink that can be accommodated in the recessed portion 6B, and also, it is possible to promote the reduction of the volume of the recessed portion 6B when the valve body 6 is pressed, so that it is possible to increase the discharging amount. As a result, the discharging performance (the speed, the amount, the linear movement properties, etc.) can be further improved.

The liquid discharge head, the head unit, the apparatus for discharging liquid, and the liquid discharging method according to one embodiment of the present invention enables the distance of linear movement of ink dots to be increased.

The liquid discharge head, the head unit, the apparatus for discharging liquid, and the liquid discharging method are not limited to the specific embodiments described in the detailed description, and variations and modifications may be made without departing from the spirit and scope of the present invention.

What is claimed is:

1. A liquid discharge head for controlling discharging of liquid, the liquid discharge head comprising:

a valve body configured to be movable, and to be pressed towards a discharge port from which the liquid is discharged; and a recessed portion in which the liquid enters, the recessed portion being provided in a leading end portion of the valve body at a position facing the discharge port, wherein the leading end portion is formed of an elastic resin, the pressing of the valve body causes the leading end portion of the valve body to be pressed against the discharge port, and the pressing of the leading end portion against the discharge port compresses the elastic resin and reduces the volume of the recessed portion.

2. The liquid discharge head according to claim 1, wherein the recessed portion has an opening diameter that is larger than a diameter of the discharge port.

3. A head unit comprising:

the liquid discharge head according to claim 1;

a liquid supply path through which the liquid is supplied to the liquid discharge head; and a liquid supply port through which the liquid is supplied to the liquid supply path.

4. An apparatus for discharging the liquid, the apparatus comprising:

the head unit according to claim 3; and a liquid discharge head moving mechanism configured to move the liquid head discharge head included in the head unit.

5. An apparatus for discharging the liquid, the apparatus comprising:

the liquid discharge head according to claim 1; and a liquid discharge head moving mechanism configured to move the liquid discharge head.

6. The liquid discharge head according to claim 1, wherein a leading end portion of the valve body is formed of a material different from a material of which the valve body is formed.

7. The liquid discharge head according to claim 1, further comprising:

a nozzle body, the discharge port being formed at an end of the nozzle body; and a sealing member, wherein the valve body is configured to be movable within the nozzle body, and the sealing member is fitted to the valve body, and is configured to seal a gap between an inner peripheral surface of the nozzle body and an outer peripheral surface of the valve body.

8. A liquid discharging method for discharging liquid, the liquid discharging method comprising:

pressing a valve body, which is movable, towards a discharge surface including a discharge port from which the liquid is discharged, to come into contact with the discharge surface, the valve body including a recessed portion in which the liquid enters, the recessed portion being formed a leading end portion of the valve body at: a position facing the discharge port, and the leading end portion is formed of an elastic resin; and pressing the valve body toward the discharge port, wherein the pressing of the valve body causes the leading end portion of the valve body to be pressed against the discharge port, and the pressing of the leading end portion against the discharge port compresses the elastic resin and reduces the volume of the recessed portion.

* * * * *